United States Patent [19]

Tubesing

[11] 4,188,935

[45] Feb. 19, 1980

[54] ROLLER HANDLE FOR SAW

[76] Inventor: William W. Tubesing, 1000 Montreal Rd., Clarkston, Ga. 30021

[21] Appl. No.: 911,288

[22] Filed: May 31, 1978

[51] Int. Cl.[2] ..... B24B 23/02; B28D 1/04

[52] U.S. Cl. ..... 125/13 R; 51/170 PT; 30/122

[58] Field of Search ..... 30/371, 373, 122, 379; 51/170 PT; 125/13 R, 14

[56] References Cited

U.S. PATENT DOCUMENTS

| | | | |
|---|---|---|---|
| 2,676,624 | 4/1954 | Gecmen | 30/373 |
| 3,091,851 | 6/1963 | Cummins | 30/371 |
| 3,092,156 | 6/1963 | Hayden | 30/371 |
| 3,656,468 | 4/1972 | Welden | 125/13 R |
| 3,931,676 | 1/1976 | Merle | 30/379 |

*Primary Examiner*—Jimmy C. Peters
*Attorney, Agent, or Firm*—B. J. Powell

[57] ABSTRACT

A handle assembly for a portable powered saw of the chain saw type which has an inverted, generally U-shaped handle with its upper central portion extending over the saw and the depending legs extending downwardly along opposite sides of the saw with a roller rotatably mounted between the depending ends of the legs under the saw so that the saw can be rested on the roller and rolled along to make long cuts with the saw, yet the handle assembly can be used to completely support the saw manually in its usual manner.

5 Claims, 4 Drawing Figures

ROLLER HANDLE FOR SAW

BACKGROUND OF THE INVENTION

1. Field of the Invention

This invention relates generally to portable manually held saws which are equipped with a saw chain or a circular saw blade and more particularly relates to a handle construction for attachment to such lightweight portable saws.

2. Description of the Prior Art

Self-propelled portable saws which are adapted to be manually held have gained widespread use in a number of applications. These saws are generally referred to as chain saws since most of these type saws carry a saw chain thereon that is adapted to cut wood. Because of the high portability of these saws, attachments have been added to the saws in lieu of the saw chain to allow the saws to be used to cut other material besides wood. These attachments generally consist of a reinforced abrasive circular blade which allows this type saw to be used to cut concrete, metal and other materials that cannot be easily cut with the saw chain. These saws with the circular abrasive blade have found widespread use in the building and construction industry and for emergency and rescue operations. Quite frequently, these saws, especially those equipped with the circular abrasive type blade, are used to make relatively long cuts both horizontally and vertically. Because such saws are adapted to be manually held, problems have been encountered when the saws are used to make these long cuts due to the instability inherent with the fact that these saws have to be manually held.

SUMMARY OF THE INVENTION

These and other problems and disadvantages associated with the prior art are overcome by the invention disclosed herein by providing a handle assembly which permits the saw to be partially supported during the long cuts which may need to be made to reduce the instability of the saw normally associated with totally supporting the saw manually during these long cuts. The invention provides a roller which can be rested on a convenient surface adjacent the cut to steady the saw while at the same time permitting the saw to be easily moved axially along its length to make the elongated cut.

The apparatus of the invention includes a handle which is adapted to replace the front wrap-around type handle normally associated with these types of saws. The front handle is attached to the saw in the same manner as prior handles are attached thereto using the same attachment points provided on the saw. The front handle assembly includes an inverted, generally U-shaped tubular handle with an upper central portion oriented generally normal to the cutting plane of the saw and a pair of legs which depend from opposite ends of the central portion on opposite sides of the saw and which are provided at the lower depending ends with flattened portions to mount a roller therebetween. An upper brace connects the handle tube to the top of the prime mover and a lower brace assembly connects the lower portion of the depending legs of the tubular handle to the bottom of the prime mover. The roller is rotatably mounted between the depending ends of the tubular handle along an axis of rotation generally normal to the cutting plane so that, as a long cut is being made, the operator can rest the roller on a support surface to steady the saw while the long cut is being made. Because the roller is oriented normal to the cutting plane, the cutting element of the saw is maintained normal to the surface of the material being cut to prevent binding or otherwise damagine the cutting element.

These and other features and advantages of the invention will become more clearly understood upon consideration of the accompanying drawings in the following description wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
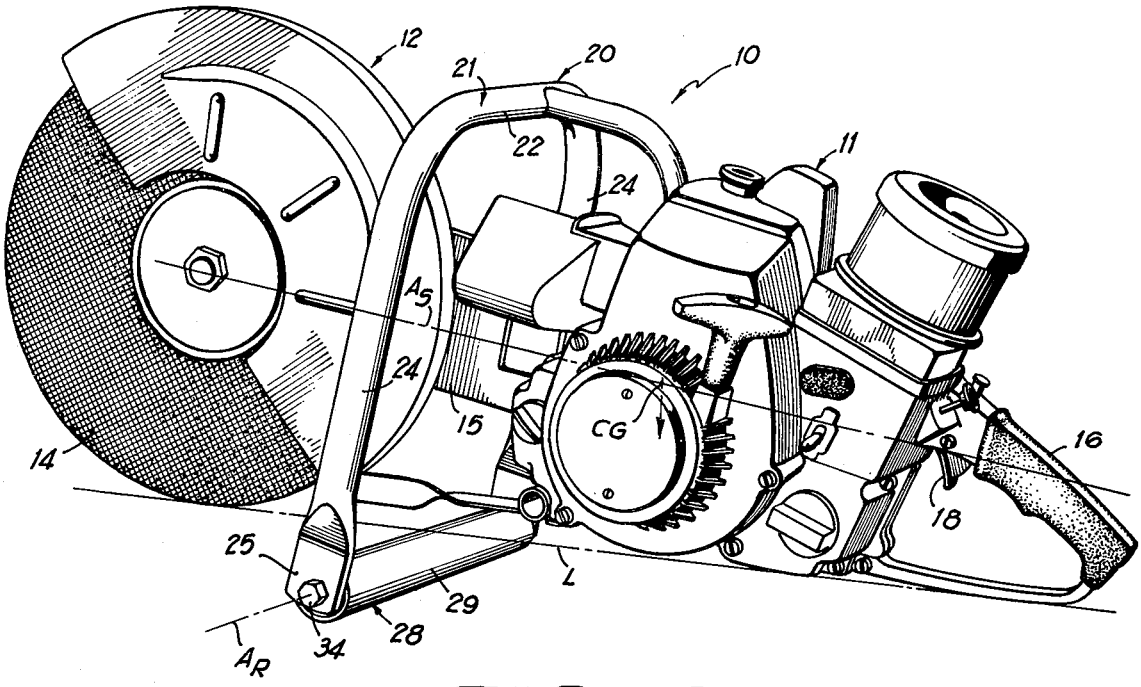
FIG. 1 is a perspective view illustrating the invention.
Figure 4:
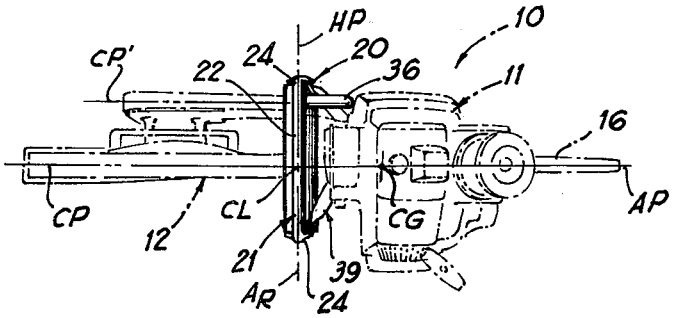

FIG. 1 shows the invention incorporated on a lightweight portable saw 10 which has a prime mover 11, here shown as a gasoline engine and a cutting assembly 12. The particular cutting assembly 12 illustrated has a circular, reinforced, abrasive cutting blade 14 which is carried by and drivingly connected to the prime mover 11 through an appropriate drive unit 15. This particular cutting assembly 12 is interchangeably mounted on the prime mover 11 in lieu of the chain saw type cutting assembly normally associated with these saws. The drive unit 15 attaches to the prime mover 11 in the same manner as the chain saw attachment is attached thereto and has an appropriate driving element which connects the output shaft of the prime mover to the arbor on which the cutting blade 14 is mounted. It will be seen that the center of gravity CG of the prime mover 11 lies on a central saw axis $A_S$ (FIG. 1) in a generally vertical axial plane AP which extends through the prime mover. This axial plane AP is best seen in FIG. 4. It will also be seen that the cutting blade 14 is designed to cut in a cutting plane CP which is parallel to the axial plane AP also best seen in FIG. 4. If the chain saw attachment were used in lieu of the cutting assembly 12 illustrated, then the chain saw would cut in the cutting plane CP' also seen in FIG. 4. It will be noted that the cutting plane CP is axially aligned with the axial plane AP while the cutting plane CP' would be parallel to but displaced laterally of the axial plane AP.

A rear handle 16 is mounted on the prime mover 11 and extends rearwardly therefrom in the axial plane AP. This rear handle usually has a throttle control 18 associated therewith as seen in FIG. 1. Thus, when the operator grasps the rear handle 16, the lifting force exerted on the saw 10 will be located in the axial plane AP.

Figure 3:
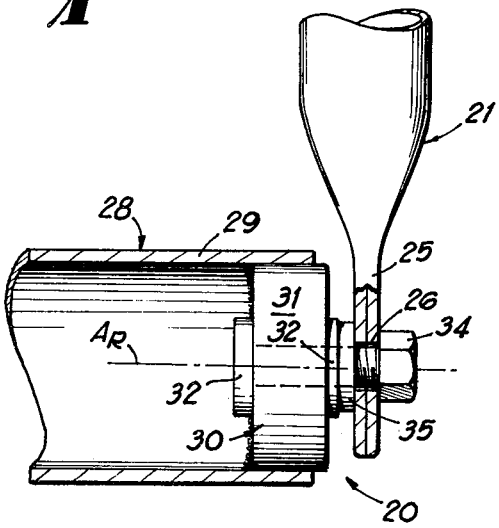
FIG. 3 is an enlarged longitudinal cross-sectional view of one end of the roller of the invention; and, FIG. 4 is a reduced top view of the handle assembly seen in FIG. 2 showing the saw in phantom lines.

A front handle assembly 20 is mounted on the front end of the prime mover 11 around the cutting assembly 12 so that the cutting blade 14 is located forwardly of the front handle assembly 20. The front handle assembly 20 lies generally in the handle plane HP seen in FIG. 4 which is oriented generally normal to the axial plane AP and intersects the axial plane AP along a line generally normal to the saw axis $A_S$. The front handle assembly 20 includes generally an inverted, U-shaped tubular handle 21 with an upper central portion 22 from the opposite ends of which depend a pair of spaced apart legs 24 oriented generally parallel to the axial plane AP and located laterally outwardly thereof on opposite sides of the axial plane. The depending end of the tubular legs 24 are each flattened as indicated at 25 to provide an attachment end thereon. The legs 24 both lie in the handle plane HP with each of the attachment ends 25 defining an attachment hole 26 therethrough as seen in FIG. 3. The attachment holes 26 are coaxially aligned along a common axis $A_R$ oriented normal to the axial plane AP, lying in the handle plane HP, and normal to the saw axis $A_S$. The axis $A_R$ lies below the common line joining the foremost portion of the cutting blade 14 and the bottom of the prime mover 11 as seen in FIG. 1 with the common line being referenced by the numeral L.

The front handle assembly 20 also includes a roller assembly 28 which is connected to the attachment ends 25 of the tubular handle 21 concentrically about the common axis $A_R$. The roller assembly 28 includes a tubular roller 29 which mounts in each of the opposite ends thereof a roller bearing 30 whose outer race 31 is press fitted into the end of the tubular roller 29. A cylindrical plug 32 is press fitted into the inner race of each of the roller bearings 30 and is internally threaded to be threadedly engaged by cap screw 34 which is received through the attachment hole 26 in the flattened attachment end 25 of the leg 24 on handle 21 and then screwed into the cylindrical plug 32 with an appropriate washer 35 to lock the cylindrical plug 32 and thus the inner race of the roller bearing 30 to the depending flattened end 25 of the leg 24. Thus, it will be seen that the length of the roller assembly 28 is selected so that the tubular roller 29 will just fit between the depending ends of the legs 24 on the tubular handle 21 and the cap screws 34 inserted through the attachment holes 26 in the legs 24 and screwed into the cylindrical plugs 32 to attach the roller assembly 28 to the depending ends of the legs 24 about the common axis $A_R$ about which the tubular roller 29 freely rotates. Thus, the tubular roller 29 is located in the handle plane HP below the common line L and also normal to the axial plane AP and saw axis $A_S$ so that the saw 10 will rest on the tubular roller 29.

Figure 2:
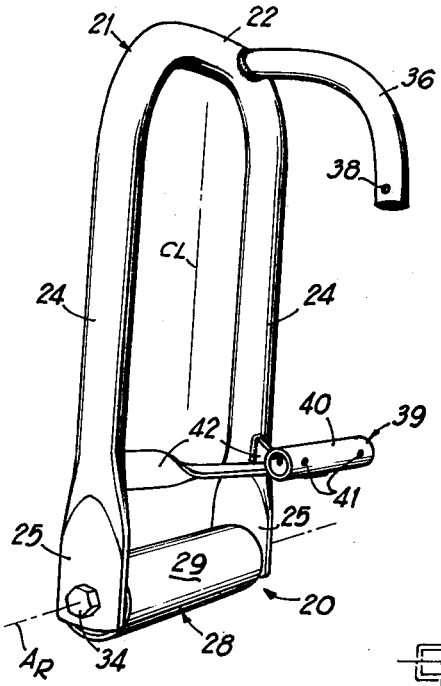
FIG. 2 is an enlarged perspective view of the handle assembly of the invention.

The prime mover 11 comes equipped with upper and lower attachment points where the front handle assembly 20 is to be attached. An upper curved tubular brace 36 is connected to the upper central portion 22 of the tubular handle 21 to connect the top of the front handle assembly 20 to the upper attachment point on the prime mover 11. An appropriate attachment hole 38 is provided in the tubular brace 36 to be used in attaching the brace 36 to the prime mover 11. It will be noted in FIG. 4 that the tubular brace 36 is displaced away from the vertical center line CL of the front handle assembly 20 as seen in FIGS. 2 and 4.

A lower attachment assembly 39 is provided for connecting the lower portion of the front handle assembly 20 to the lower attachment point on the prime mover 11. The lower attachment assembly 39 includes a lower attachment tube 40 provided with attachment holes 41 as seen in FIG. 2 to connect the attachment tube 40 to the lower attachment point on the prime mover 11 as seen in FIG. 1. A pair of angle braces 42 extend between the legs 24 on the tubular handle 21 and the lower attachment tube 40 to locate the lower portions of the front handle assembly 20. The angle braces 42 are plates which have been twisted intermediate their ends at 90° rotation about their axes so that the portion of the angle brace 42 attached to the legs 24 is generally vertically oriented while that portion of the angle braces 42 attached to the lower attachment tube 40 is generally horizontally oriented. The angle braces 42 angle inwardly from the legs 24 to about the center of the lower attachment tube 40 and lie in a plane generally normal to the handle plane HP. The brace 36 and attachment assembly 39 locate the handle 21 and roller assembly 28 so that the vertical center line CL of handle assembly 20 is generally co-planar with the axial plane AP and normal to saw axis $A_S$ so that the legs 24 are positioned laterally outwardly from the axial plane AP equidistant to balance the saw 10.

Because the front handle assembly 20 is about the same weight as the prior art loop handle normally associated with these types of saws, no significant weight is added to the overall saw weight by the front handle assembly 20. This means that the saw 10 can be used by manually supporting the saw through the front handle 21 and the rear handle 16 in conventional manner. Additionally, the tubular roller 29 can be rested on either the surface of the material being sawn by the cutting blade 14 or on a convenient supporting surface adjacent thereto so that the primary weight of the saw 10 is supported through the roller 29 and the saw will be steadied by the roller 29. Additionally, when a long cut is being made, the operator simply rests the roller 29 on the supporting surface and uses the rear handle 16 to pivot the saw about the roller 29 to cause the cutting blade 14 to engage the material to be sawn and the saw 10 can be rolled along the surface on the roller 29 to make an elongate cut.

I claim:

1. A saw construction including:

a prime mover having a front end and a rear end with the center of gravity acting through a common axial plane;

a sawing assembly drivingly connected to and mounted on said prime mover, said sawing assembly including a cutting element having an effective cutting portion extending forwardly of the front end of said prime mover and adapted to cut in a cutting plane generally parallel to said common axial plane;

a rear handle connected to said prime mover and extending rearwardly of the prime mover along the common axial plane; and a front handle assembly connected to said prime mover and located between the front end of said prime mover and the effective cutting portion of the cutting element of said sawing assembly, said front handle assembly including an inverted, generally U-shaped tubular handle comprising a central upper portion and depending legs at opposite ends thereof, said upper central portion located over said prime mover and said legs oriented on opposite sides of said prime mover and extending generally parallel to the common axial plane, a roller rotatably mounted between the depending ends of said legs about an axis of rotation oriented generally perpendicular to the common axial plane and the cutting plane to act as a guide and support for the saw construction, an upper brace connecting said upper central portion of said tubular handle to said prime mover, and a lower brace assembly connecting both of said depending legs of said tubular handle to said prime mover.

2. The saw construction of claim 1 wherein said tubular handle lies generally in a handle plane oriented generally normal to the common axial plane.

3. A saw construction including:

a prime mover having a front end and a rear end with the center of gravity acting through a common axial plane;

a sawing assembly drivingly connected to and mounted on said prime mover, said sawing assembly including a cutting element having an effective cutting portion extending forwardly of the front end of said prime mover and adapted to cut in a cutting plane generally parallel to said common axial plane;

a rear handle connected to said prime mover and extending rearwardly of the prime mover along the common axial plane; and a front handle assembly connected to said prime mover and located between the front end of said prime mover and the effective cutting portion of the cutting element of said sawing assembly, said front handle assembly including an inverted, generally U-shaped tubular handle comprising a central upper portion and depending legs at opposite ends thereof, said upper central portion located over said prime mover and said legs oriented on opposite sides of said prime mover and extending generally parallel to the common axial plane, and a roller rotatably mounted between the depending ends of said legs about an axis of rotation oriented generally perpendicular to the common axial plane and the cutting plane to act as a guide and support for the saw construction; said roller including a roller tube, a pair of bearings mounted in opposite ends of said roller tube and a pair of screw assemblies mounting said bearings on the depending ends of said depending legs of said inverted, U-shaped tubular handle so that said roller tube is rotatable with respect to said screw assemblies.

4. A handle construction for a portable powered saw including:

an inverted generally U-shaped tubular handle comprising a central portion and a pair of depending legs at opposite ends of said central portion, said depending legs oriented generally normal to said central portion and parallel to each other, and said central portion and said depending legs of said tubular handle lying in a common plane; and a roller rotatably mounted between those ends of the said depending legs opposite said central portion, said roller including a roller tube; a pair of bearings mounted in opposite ends of said roller tube and mounting means operatively connecting said bearings to said depending legs of said tubular handle so that said roller tube is freely rotatable with respect to said depending legs of said tubular handle.

5. The handle construction of claim 4 further including upper attachment means mounted on said central portion of said tubular handle to operatively connect said handle construction to the saw and lower connecting means for operatively connecting each of said depending legs of said tubular handle to the saw to mount said handle construction on the saw.

* * * * *